US006427907B1

(12) United States Patent
Espinoza et al.

(10) Patent No.: US 6,427,907 B1
(45) Date of Patent: Aug. 6, 2002

(54) SIDE LOADING STORAGE BOX

(75) Inventors: Alfred D. Espinoza, La Habra; Robert R. Foreman; Emily M. Okasaki, both of Stockton, all of CA (US)

(73) Assignee: R. R. Foreman and Company, Stockton, CA (US)

( * ) Notice: Subject to any disclaimer, the term of this patent is extended or adjusted under 35 U.S.C. 154(b) by 32 days.

(21) Appl. No.: 09/650,225

(22) Filed: Aug. 29, 2000

Related U.S. Application Data

(63) Continuation-in-part of application No. 09/389,780, filed on Sep. 3, 1999, now Pat. No. 6,234,385.

(51) Int. Cl.[7] ..... B65D 5/42

(52) U.S. Cl. ..... 229/122; 229/125.015; 229/125.11; 229/149; 229/162; 229/915

(58) Field of Search ..... 229/122, 125.015, 229/125.11, 149, 150, 162, 915; 206/425

(56) References Cited

U.S. PATENT DOCUMENTS

| | | | | | |
|---|---|---|---|---|---|
| 264,383 | A | | 9/1882 | Weiner | |
| 457,390 | A | | 8/1891 | Weeks | |
| 2,162,089 | A | | 6/1939 | Kagen | 229/122 |
| 2,180,691 | A | | 11/1939 | Olivier | |
| 2,591,593 | A | | 4/1952 | Nolan | |
| 2,663,485 | A | | 12/1953 | Johnson | |
| 2,788,827 | A | | 4/1957 | Banner | 150/52 |
| 3,050,228 | A | | 8/1962 | Lane | 229/122 |
| 3,370,775 | A | | 2/1968 | Link | 229/122 |
| 3,392,902 | A | * | 7/1968 | Donovan | 229/162 |
| 3,398,000 | A | | 8/1968 | Peters | |
| 3,441,193 | A | * | 4/1969 | Castle | 229/122 |
| 3,552,579 | A | | 1/1971 | Simon et al. | 211/126 |
| 3,858,720 | A | | 1/1975 | Flagler | 206/216 |
| 4,142,566 | A | | 3/1979 | Stolp | 150/52 |
| 4,353,495 | A | | 10/1982 | Jes | 229/122 |
| 4,436,243 | A | | 3/1984 | Nason et al. | |
| 4,550,853 | A | | 11/1985 | Grati | |
| 4,817,861 | A | | 4/1989 | Henrikson | 229/122 |
| 4,955,925 | A | | 9/1990 | Platti | 15/257.6 |
| 5,197,661 | A | * | 3/1993 | Sanchez | 229/162 |
| 5,201,828 | A | * | 4/1993 | Martin | 229/162 |
| 5,259,631 | A | | 11/1993 | Brande | 229/121 |
| D372,673 | S | | 8/1996 | Turner | D9/432 |
| 5,813,597 | A | | 9/1998 | Wakevainen | 229/122.1 |
| 6,234,385 | B1 | * | 5/2001 | Espinoza et al. | 229/122 |

FOREIGN PATENT DOCUMENTS

| | | | | |
|---|---|---|---|---|
| EP | 279754 A2 | * | 8/1988 | 229/162 |

OTHER PUBLICATIONS

Brochure for "Perma–Stor Computer Printout Binder File".
Brochure for "Fellows Bankers Box".
Brochure for "Acco Transfer Drawers".

* cited by examiner

*Primary Examiner*—Gary E. Elkins
(74) *Attorney, Agent, or Firm*—JDI Patent; Joshua D. Isenberg

(57) ABSTRACT

A single-piece side-loading box includes a top, a bottom, a plurality of wall portions, and a side-opening panel in one unitary piece. The unitary piece is foldable from an unformed configuration to a box configuration with the side-opening panel openable in the box configuration to permit access to an interior of the box. The plurality of wall panels are connected between the top and the bottom in the box configuration. At least some of the wall panels in the box configuration overlap to form one or more multi-panel walls. The box includes a releasable fastening mechanism for fastening the side-opening panel in the closed position. The releasable fastening mechanism may be part of the unitary piece. The releasable fastening mechanism may include mechanical couplers, latching tabs, magnetic members, Velcro strips, or the like. The side-opening panel may be transparent or include a transparent portion attached to an opaque frame. The transparent panel may include a decorative pattern. The box can be fitted with various inserts to partition the box for storing different types of articles.

19 Claims, 11 Drawing Sheets

SIDE LOADING STORAGE BOX

This application is a continuation-in-part and claims the benefit of U.S. patent application Ser. No. 09/389,780, filed Sep. 3, 1999, now U.S. Pat. No. 6,234,385 the entire disclosure of which is incorporated herein by reference.

BACKGROUND OF THE INVENTION

A conventional storage container top-loading box has one or more vertical sides and a bottom formed into an enclosure with an opening at the top. The container is typically fitted with a lid configured to close the opening at the top. The lid may be hinged to the top of one or more of the vertical sides. Alternatively the lid may be a separate removable piece. Often the container is provided with dividers or inserts that divide up the interior of the box into separate compartments for protection and organization of the articles stored in the container. Although such containers have been used from time immemorial to store articles, they suffer drawbacks. Most notably, if, as is often the case, it is desirable to stack a plurality of such containers for storage, the containers must be unstacked to gain access to the contents of the containers below the top of the stack. To overcome this, side-loading containers have been developed.

Side-loading boxes have been known in the art of box making for over 100 years. The basic construction of such a side-loading box is similar to that of the more conventional top-loading box laid upon one of its vertical sides such that the opening is at the side rather than the top. However, slightly different construction is necessary for the side opening box in order to provide satisfactory ways of closing the open side.

One solution simply provides a conventional top-loading box with one side that folds down. The folding side is often secured in place by a conventional lid. Although side-loading boxes of this type provide satisfactory loading, they suffer from drawbacks. First, the folding side panel weakens the structure of the box limiting the maximum load that can be stored before the box begins to bulge. Second, the weakening of the box limits the maximum height to which such boxes can be stacked. Third, if the lid is of the conventional type, it must be either displaced or removed in order to open the side panel. If the lid is integrally incorporated into the top of the box, it is often necessary to open the box by wedging the fingers of the hand in between the side-opening panel and the top of the box to pry the box open. In addition to the associated discomfort, this method of opening the box eventually weakens either the top or the side-opening panel or both. In some cases a string-and-button type latch secures the side-opening panel. Alternatively, a metal or plastic turn-knob type latch is provided. Unfortunately, both of these latching mechanisms complicate construction and add to the cost of the box.

An additional disadvantage of prior art side-loading and top-loading boxes occurs when the box is constructed of material such as corrugated cardboard. For example, single-wall corrugated boxes require braces, sidewall stiffeners or other structural reinforcement to withstand the weight of multiple stacked loaded boxes. Such stiffeners are typically made from metal, wood, wire or plastic and provide the necessary mechanical strength to withstand heavy loads. For example, conventional side-loading boxes, loaded with 15 to 20 pounds of articles in each box, can be stacked two boxes high without bracing. Beyond that, either the boxes must be less heavily laden or sidewall stiffeners are necessary for at least the lowermost boxes in the stack.

A further disadvantage of prior art boxes of both types lies in the fact that they are often of multi-piece construction. Such boxes are often delivered in pallet loads requiring up to four separate pallets for the boxes, the lids, the stiffeners, and the inserts. The multiple pallet loads necessitate additional manufacturing, warehousing and transportation expenses.

Thus, there is a need in the art, for a side-loading box that can be easily opened and stacked without requiring stiffeners or braces.

SUMMARY OF THE INVENTION

The present invention is directed to a single-piece side-loading box having a side-opening panel which is openable to permit access to the interior of the box. Specific embodiments of the box include a multiple side-wall construction, a transparent side-opening panel, and/or a releasable fastening and handle mechanism for releasably fastening the side-opening panel to the remainder of the box. The releasable fastening and handle mechanism may be integrally formed with the box as a single-piece which is foldable into a box configuration.

In accordance with an aspect of the present invention, a single-piece side-loading box comprises a bottom, a plurality of wall panels, a top, and a side-opening panel. The bottom, wall panels, top, and side-opening panel are fabricated in a unitary piece which is foldable from an unformed configuration to a box configuration with the side-opening panel openable in the box configuration to permit access to an interior of the box. The plurality of wall panels are connected between the top and the bottom in the box configuration. At least some of the wall panels in the box configuration overlap to form one or more multi-panel walls.

In accordance with another aspect of the invention, a single-piece side-loading box comprises a bottom, a plurality of wall panels, a top, and a side-opening panel. The bottom, wall panels, top, and side-opening panel are fabricated in a unitary piece which is foldable from an unformed configuration to a box configuration with the side-opening panel movable between a closed position and an open position in the box configuration to permit access to an interior of the box. The plurality of wall panels are connected between the top and the bottom in the box configuration. A releasable fastening and handle mechanism is coupled to the side-opening panel for releasably fastening the side-opening panel in the closed position.

In accordance with another aspect of this invention, a side-loading box comprises a bottom, a plurality of wall panels, and a top. The top, bottom, and wall panels are fabricated in a unitary piece which is foldable from an unformed configuration to a box configuration. The plurality of wall panels are connected between the top and the bottom in the box configuration. A side-opening panel is movable between a closed position and an open position in the box configuration to permit access to an interior of the box. The side-opening panel includes a transparent material.

In accordance with another aspect of the invention, a side-loading box comprises a bottom, a plurality of wall panels, and a top. The bottom includes a plurality of bottom panels overlapping to form a multi-panel bottom and including a slot formed between two of the overlapping bottom panels. The top, bottom, and wall panels are fabricated in a unitary piece which is foldable from an unformed configuration to a box configuration. The plurality of wall panels are connected between the top and the bottom in the box configuration. A side-opening panel is movable between a closed position and an open position in the box configuration to permit access to an interior of the box. The side-opening panel includes a latching flap insertable into the slot of the multi-panel bottom. In a specific embodiment, the side-opening panel is a separate panel detachably connected to the unitary piece in the box configuration.

BRIEF DESCRIPTION OF THE DRAWINGS

FIG. 1(*b*) is a simplified top plan view of the assembled box of FIG. 1(*a*);

FIG. 1(*c*) is a simplified side elevational view of the assembled box of FIG. 1(*a*);

FIG. 1(*d*), is a simplified bottom plan view of the assembled box of FIG. 1(*a*);

FIG. 1(*e*) is a simplified plan view of a cutout of an unassembled box of the type depicted in FIGS. 1(*a*)–1(*d*);

FIGS. 3(*b*)–3(*f*) depict different views of the insert of FIG. 3(*a*);

FIG. 3(*g*) depicts a simplified plan view of a cutout of an unassembled box insert of the type depicted in, FIGS. 3(*a*)–3(*f*);

FIG. 6(*b*) is a perspective view of a box illustrating a fastening mechanism for the side-opening panel in the open position according to another embodiment;

DESCRIPTION OF THE SPECIFIC EMBODIMENTS

Figure 1A:
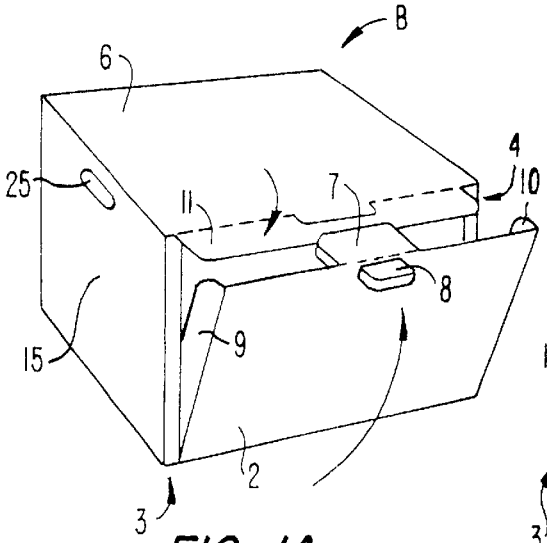
FIG. 1(*a*) is a simplified perspective view of an assembled box according to an embodiment of the present invention.
Figure 1B:
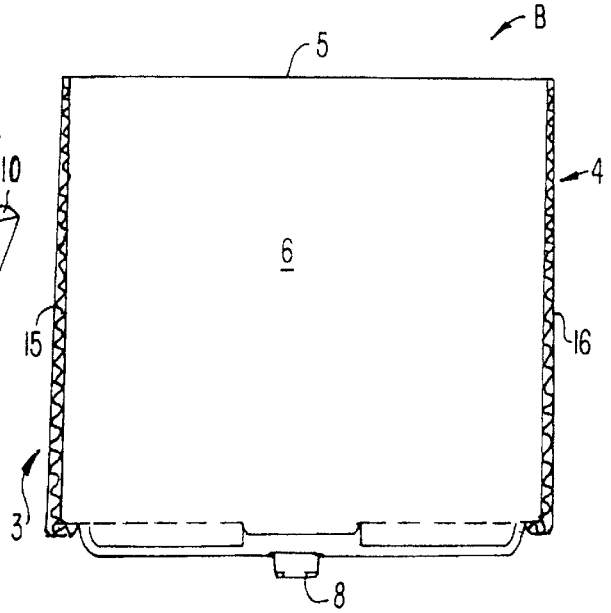
Figure 1C:
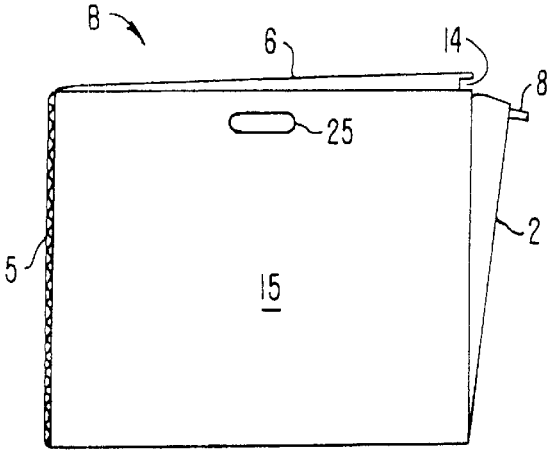
Figure 1D:
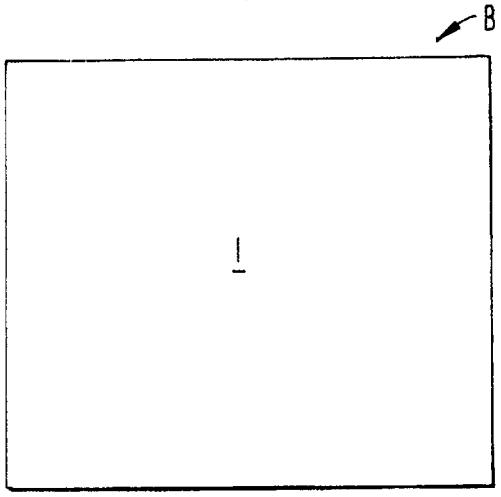
Figure 1E:
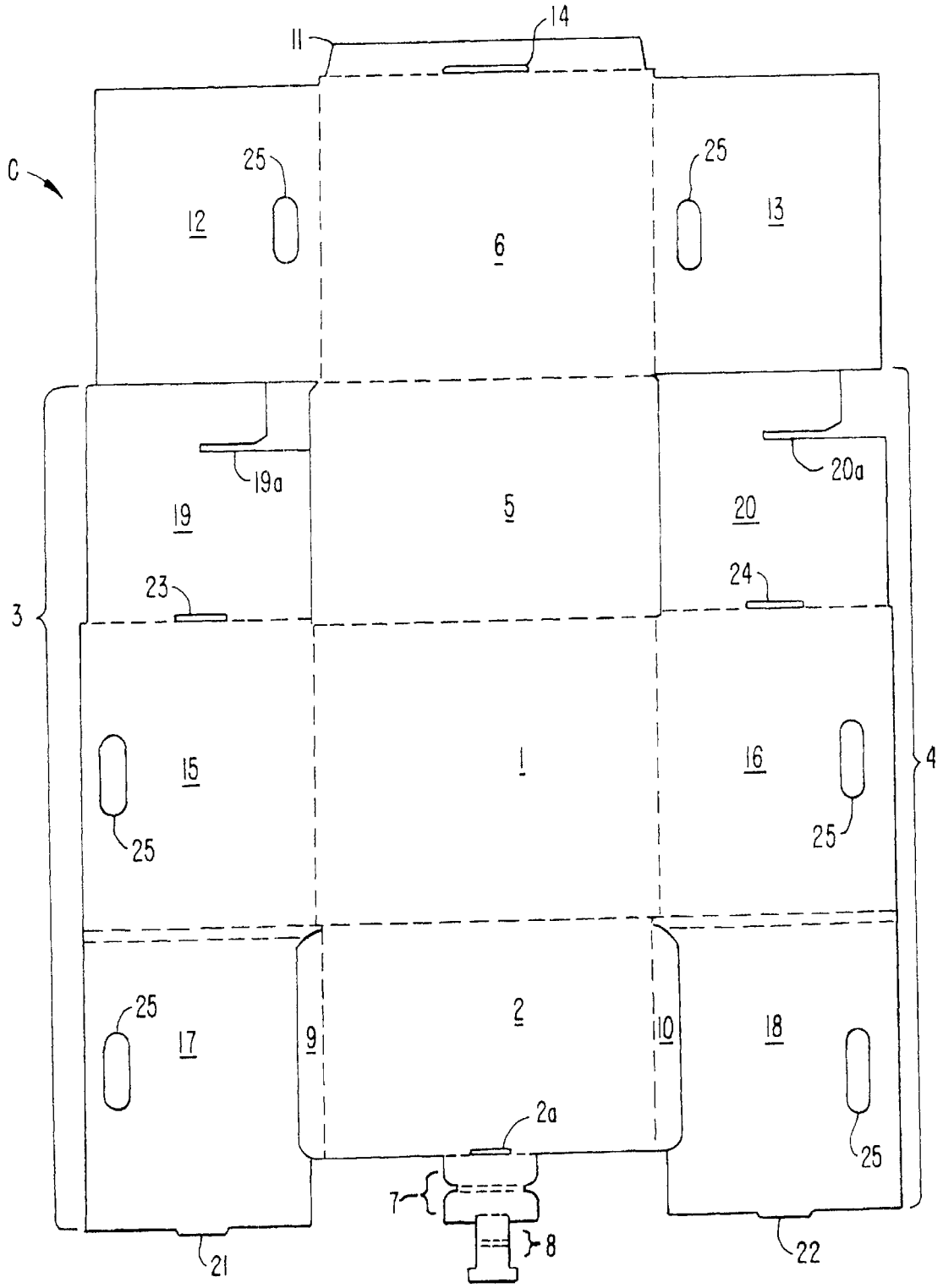
Figure 2A:
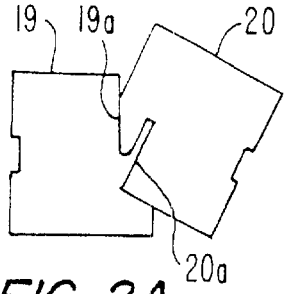
FIGS. 2(*a*)–2(*f*) depict the assembly of the box of FIGS. 1(*a*)–(*e*)
Figure 2B:
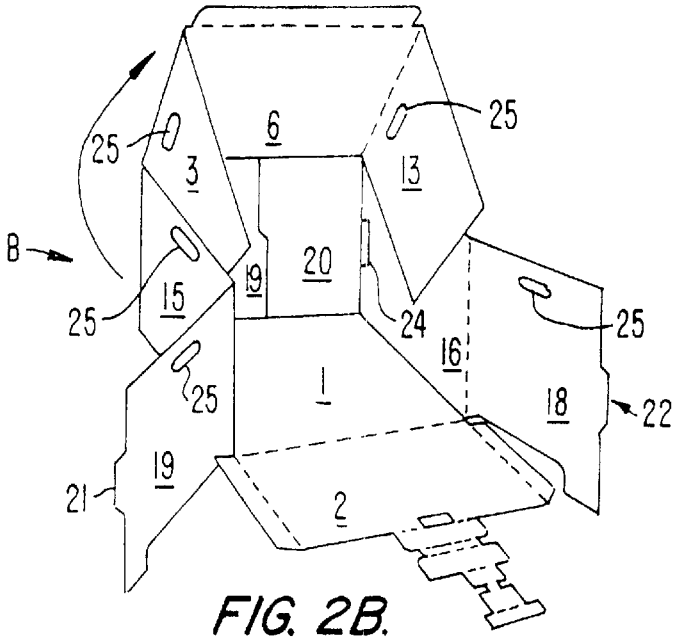
Figure 2D:
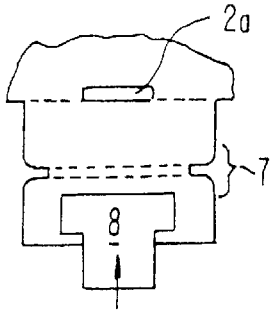
Figure 2E:
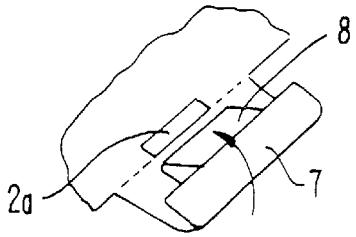
Figure 2C:
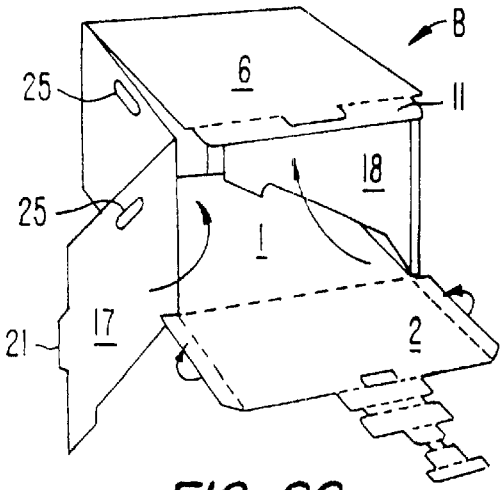
Figure 2F:
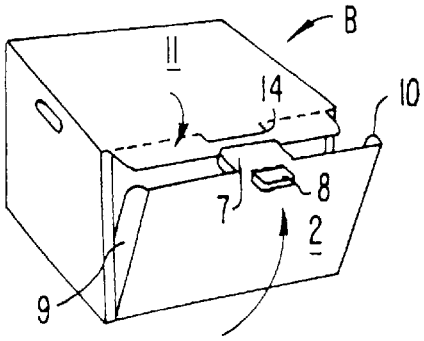
Figure 3E:
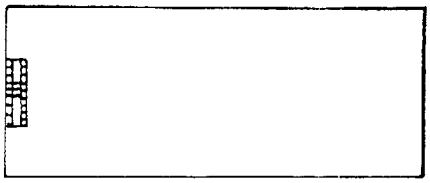
FIG. 3(*a*) is a simplified perspective view of an assembled box insert.
Figure 3F:
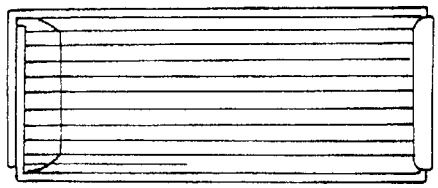
Figure 3D:
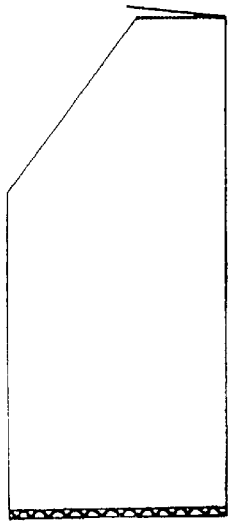
Figure 3C:
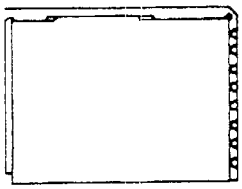
Figure 3A:
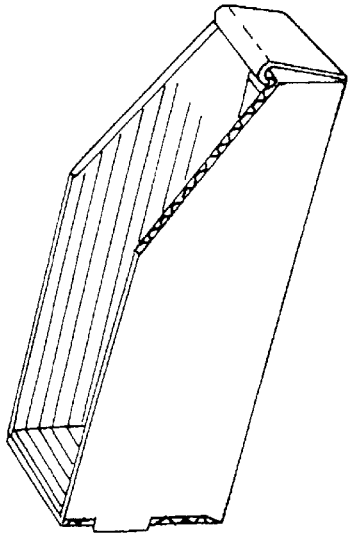
Figure 3B:
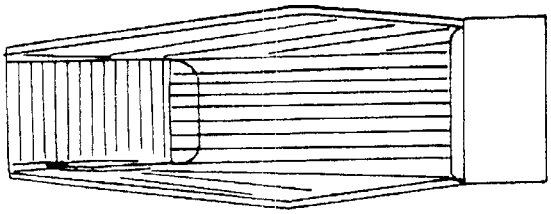
Figure 3G:
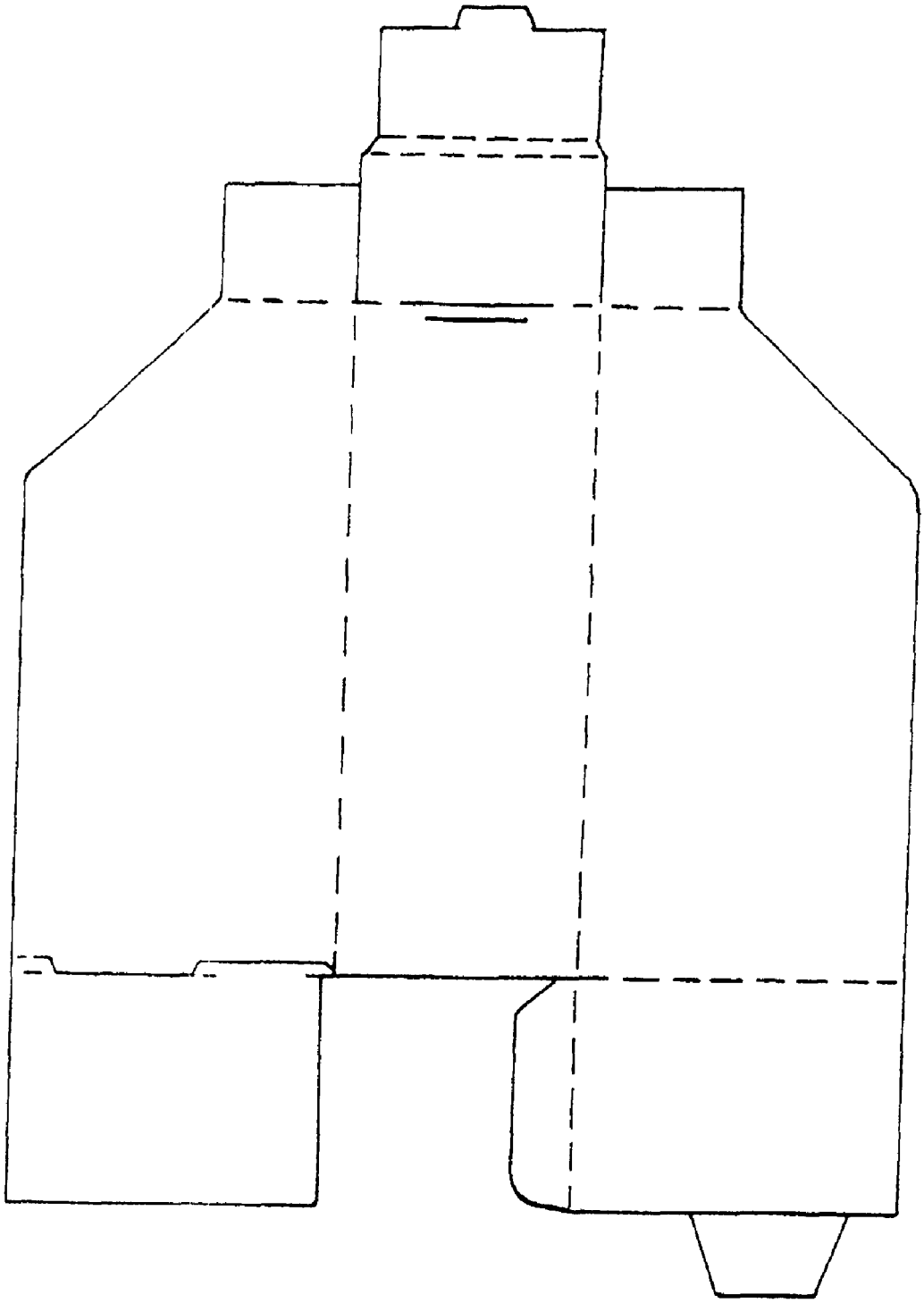
Figure 4A:
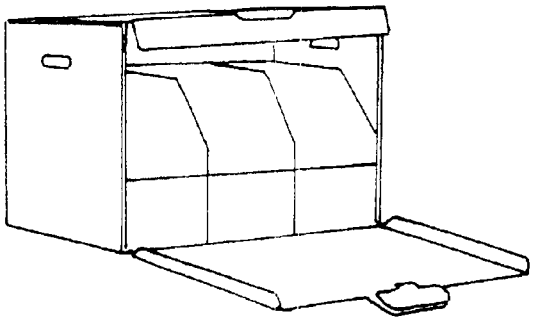
FIGS. 4(*a*)–4(*h*) depict simplified perspective views of boxes fitted with various inserts.
Figure 4B:
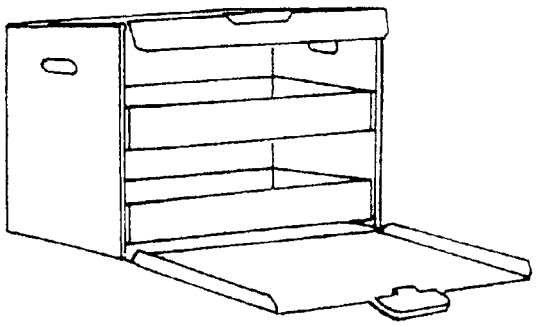
Figure 4C:
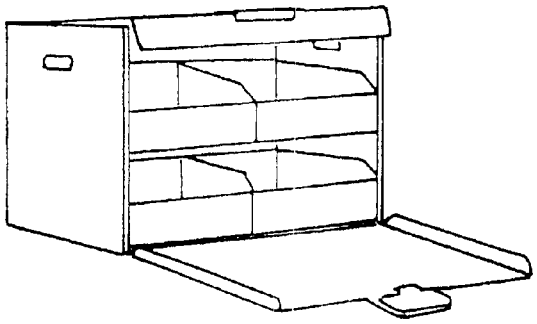
Figure 4D:
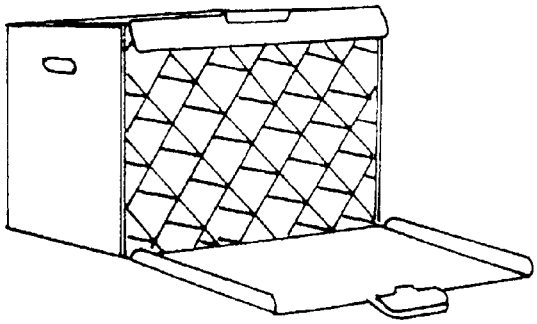
Figure 4E:
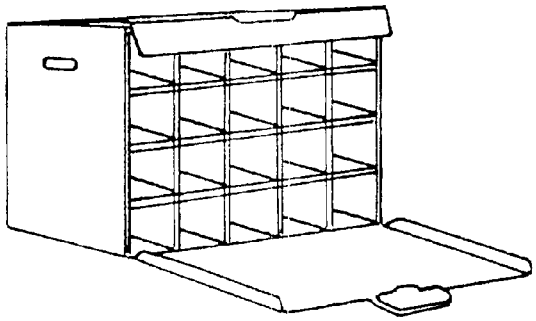
Figure 4F:
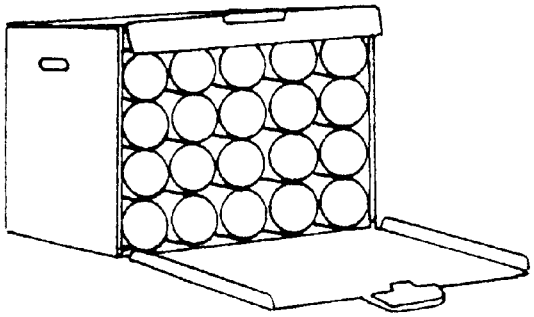
Figure 4G:
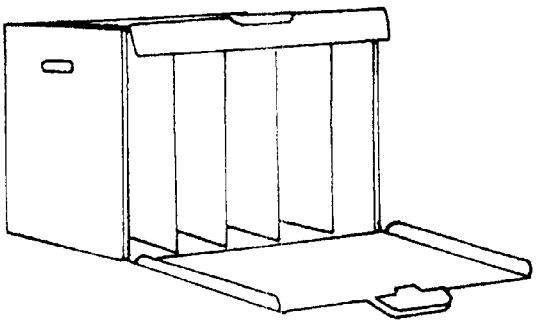
Figure 4H:
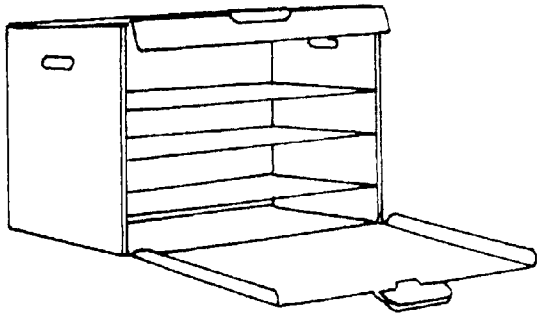

An embodiment of the side-loading box of the present invention is depicted in FIGS. 1(*a*)–1(*e*). The details of the assembled box B are apparent from FIGS. 1(*a*)–1(*d*). The one-piece box B generally includes a bottom panel 1, a front panel 2, side panels 3 and 4 and a back panel 5. The front, side, and back panels are all attached to the bottom panel 1. A lid 6 is attached to the back panel 5. A latching tab 7 is incorporated into the front panel 2. The latching tab 7 includes a handle 8 to facilitate opening and closing the box. In the embodiment shown, the front panel 2 includes side tabs 9 and 10 to provide secure closure. The lid includes a lid flap 11 and depending side reinforcements 12 and 13. The lid flap 11 includes a slot 14 that is sized to receive the latching tab 7. The lid 6 advantageously includes a rounded rectangular piece above the slot 14 which helps guide the latching tab 7 into the slot 14. In addition, the top of the front panel 2 butts up against the rounded rectangular piece when it is closed to keep the lid 6 from sagging in the middle portion.

The side panels 3 and 4 include side wall panels 15 and 16, reinforcing side wings 17 and 18, and interlocking back reinforcements 19 and 20 having slots 19*a*, 20*a*. The back reinforcements 19 and 20 interlock in front of the back panel 5 to provide additional strength at the back of the box B.

The side reinforcements 12 and 13 fit depending from lid 6 inside the box B adjacent the side wall panels 15 and 16. The side wings 17 and 18 fold back over the side reinforcements 12 and 13 to provide additional strength for the sides of the box B. Tabs 21 and 22 on the side wings 17 and 18 fit into slots 23 and 24 at the juncture of the back reinforcements 19 and 20 and the side wall panels 15 and 16 securing the side wings 17 and 18 and side reinforcements 12 and 13 in place. The side wall panels 15 and 16, side wings 17 and 18 and side reinforcements 12 and 13 thus provide the box with a triple-side-wall construction allowing the box to support a great weight. Side wall panels 15 and 16, side reinforcements 12 and 13, and side wings 17 and 18 may include cutouts 25 that align when the box is assembled to form convenient hand-holds. Material can be completely removed from box to form cutouts 25 defined by voids or aperture through the material of the box. Alternatively, one or more cutouts 25 may be formed such that the cut material defines a flap that folds inwards or outwards to allow closure of the void.

Although a box having triple-side-wall construction is disclosed herein, those skilled in the art will be able to find other methods of providing a side wall of a box with two or more reinforcements to provide multiple-side-wall construction.

In a preferred embodiment, the box is cut from a single flat piece of material prior to assembly. FIG. 1(*e*) depicts the layout of a cutout C of single flat piece of material. Generally cutout C is cut along the solid lines in FIG. 1(*e*) and folded along the dashed lines to form the box B depicted in FIGS. 1(*a*)–1(*d*). FIGS. 2(*a*)–2(*f*) depict the steps of assembling the cut piece of board of FIG. 1(*e*) into the assembled box B. First, side wall panels 15 and 16 are brought up and back reinforcements 19 and 20 are folded over each other and hooked together so that slots 19*a*, 20*a* interlock as shown in FIG. 2(*a*). The back reinforcement panels 19, 20 and the back panel 5 overlap to form a double-panel back wall. Next, lid 6 is brought up and depending side reinforcements 12 and 13 are placed inside the box as shown in FIG. 2(*b*). Then side wings 17 and 18 are folded over side reinforcements 12 and 13 and tabs 21 and 22 locked into slots 23 and 24 as shown in FIG. 2(*c*). The side reinforcements 12, 13, side wings 17, 18, and side wall panels 15, 16, overlap respectfully on each side to form a pair of triple-panel side walls. Next, handle 8 is folded over latching tab 7 as shown in FIG. 2(*d*) and handle 8 is inserted into slot 2*a* in front panel 2 as shown in FIG. 2(*e*). To close the box, lid flap 11 is folded down, front panel 2 is lifted up, side tabs 9 and 10 are folded in, and latching tab 7 is inserted into slot 14 as shown in FIG. 2(*f*).

In some preferred embodiments, the box is generally made from corrugated board such as cardboard. Such a material is typically cut into shape using conventional mechanisms such as rotary die cutters. In one preferred embodiment, the box is made from 250 lb. test corrugated board. It is understood that other types of boards may be used in alternative embodiments. Although the box is described herein as being made of corrugated board, those skilled in the art will recognize that any suitable material used in container-making can be used. Such materials include but are not limited to plastic, metal, wood, rubber, corrugated plastic, wire and laminated or composite materials incorporating any or all of these. The box may be laminated or coated with a polymer film, a shrink film, or other types of laminations including materials such as polyester, acetate, polystyrene, polyethylene, polyolefin-polyester, vinyl, plastic, and metallized films (e.g., multi-layer Coex/styrene butadiene copolymer). Examples of printed or flood coatings that may be used include aqueous coatings, Michelman coatings, and UV coatings. Some of these coatings provide the boxes with water-proof and other protective properties. The coatings may be applied to all the surfaces or some of the surfaces of the box (e.g., only external surfaces).

Boxes constructed in accordance with the above embodiment can be fitted with various inserts to partition the box for storing different types of articles. Such inserts provide for convenient filing of and access to a diverse range of articles such as documents, business materials, household articles, toys, and the like. FIGS. 3(*a*)–3(*g*) depict various views of one such type of insert. In particular, FIG. 3(*g*) depicts the layout of such an insert on a single piece of corrugated board after cutting and prior to assembly. The insert shown is an example of an embodiment of a removable vertical organizer insert. Other inserts may be used with embodiments of the box of the present invention. Such inserts include tray organizer inserts, diagonal organizer inserts, cube organizer inserts, tube organizer inserts, vertical partition inserts and horizontal partition inserts. Examples of boxes equipped with such inserts are depicted in FIGS. 4(*a*)–4(*h*). It should be noted that a combination of different inserts may be used in one box.

Figure 5:
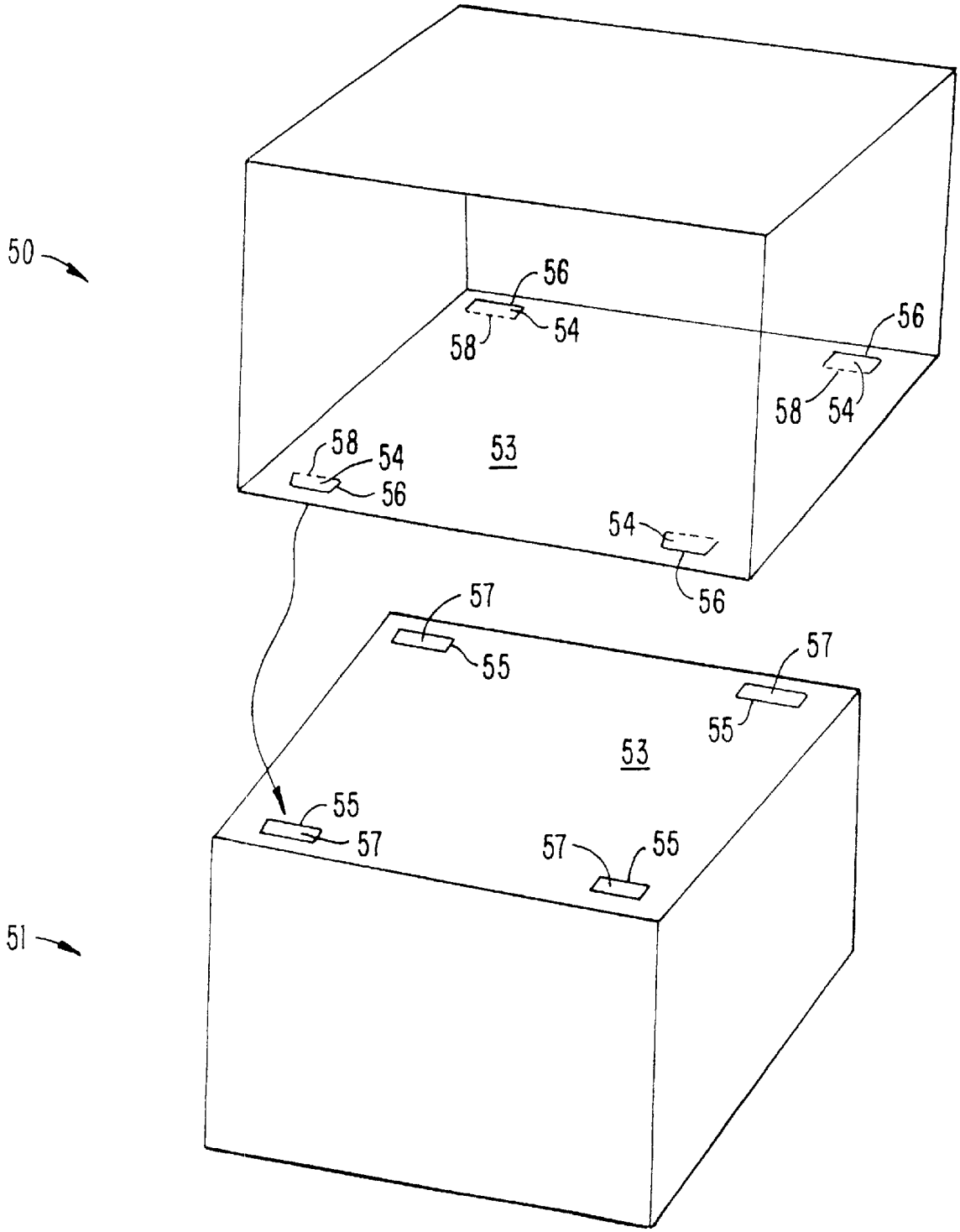
FIG. 5 depicts a simplified perspective view of two boxes configured to prevent them from moving when stacked according to an alternative embodiment of the present invention.

Side-opening containers of the type depicted herein can be configured to prevent them from moving when they are stacked. FIG. 5 depicts two boxes, e.g., of the type described above, that have been suitably configured to interlock when stacked. An upper box 50 has a bottom side 52 that includes one or more tabs 54 (four are shown) defined by perforations formed along solid lines 56. Tabs 54 fold outward (i.e., downward) along dashed lines 58 to protrude from bottom 52 of box 50. A lower box 51 includes one or more slots 55 (four are shown) in a top side 53. Slots 55 are sized and located to receive tabs 54 protruding from the bottom side 52 of upper box 50. Tabs 54 engage slots 55 to prevent motion of top box 50 and bottom box 51 relative to each other. Such slots can be made by perforating top side 53 so that cutouts 57 can be punched out if desired. Slots 55 can, alternatively, be perforated to allow cutouts 57 to fold inward, i.e., downward. Of course, boxes could be configured for stacking in stacks of three boxes high or higher, by including both tabs and slots in the layout of the cutout from which the box is formed.

Figure 6A:
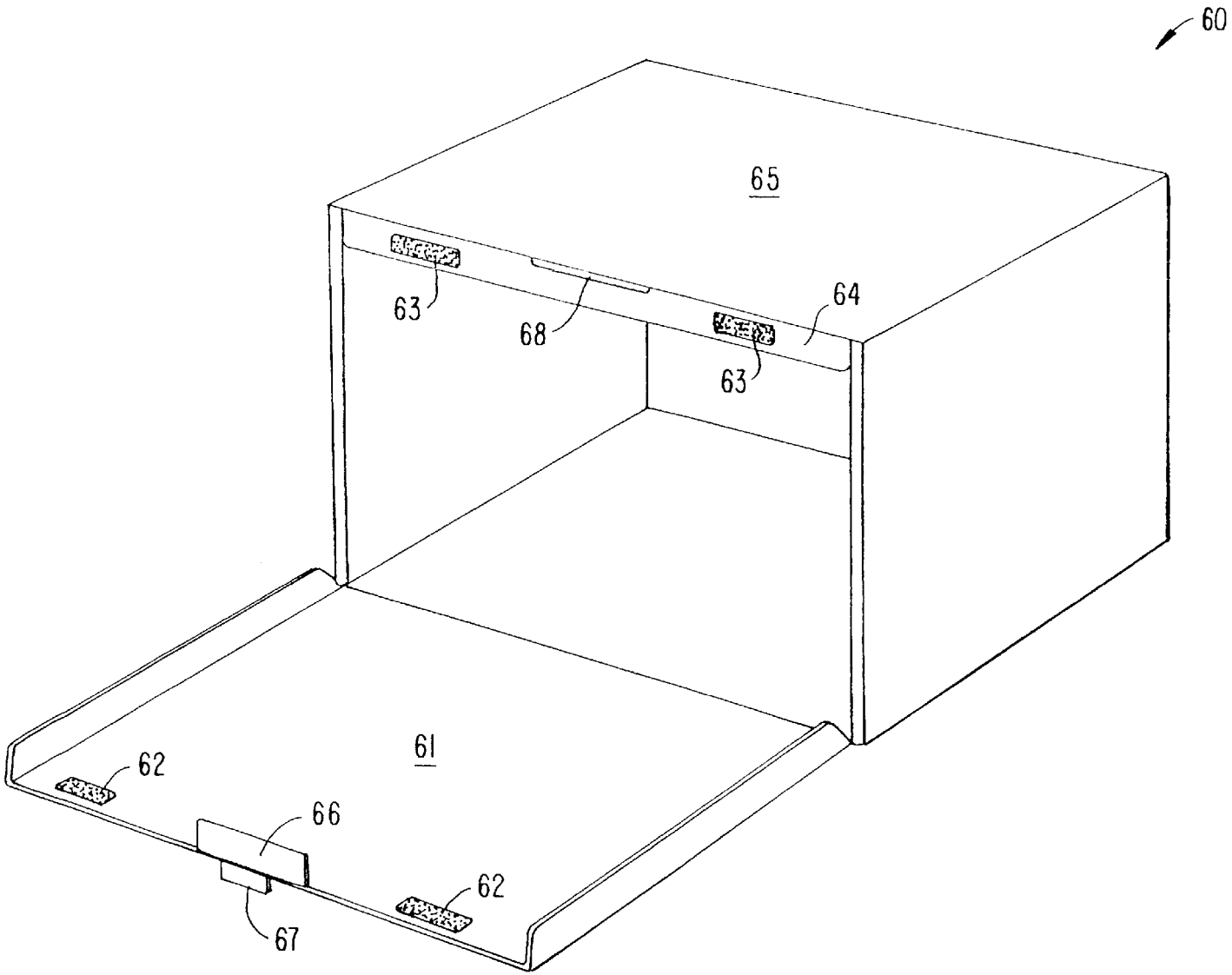
FIG. 6(*a*), is a perspective view of a box illustrating a fastening mechanism for the side-opening panel in the open position according to one embodiment.
Figure 6B:
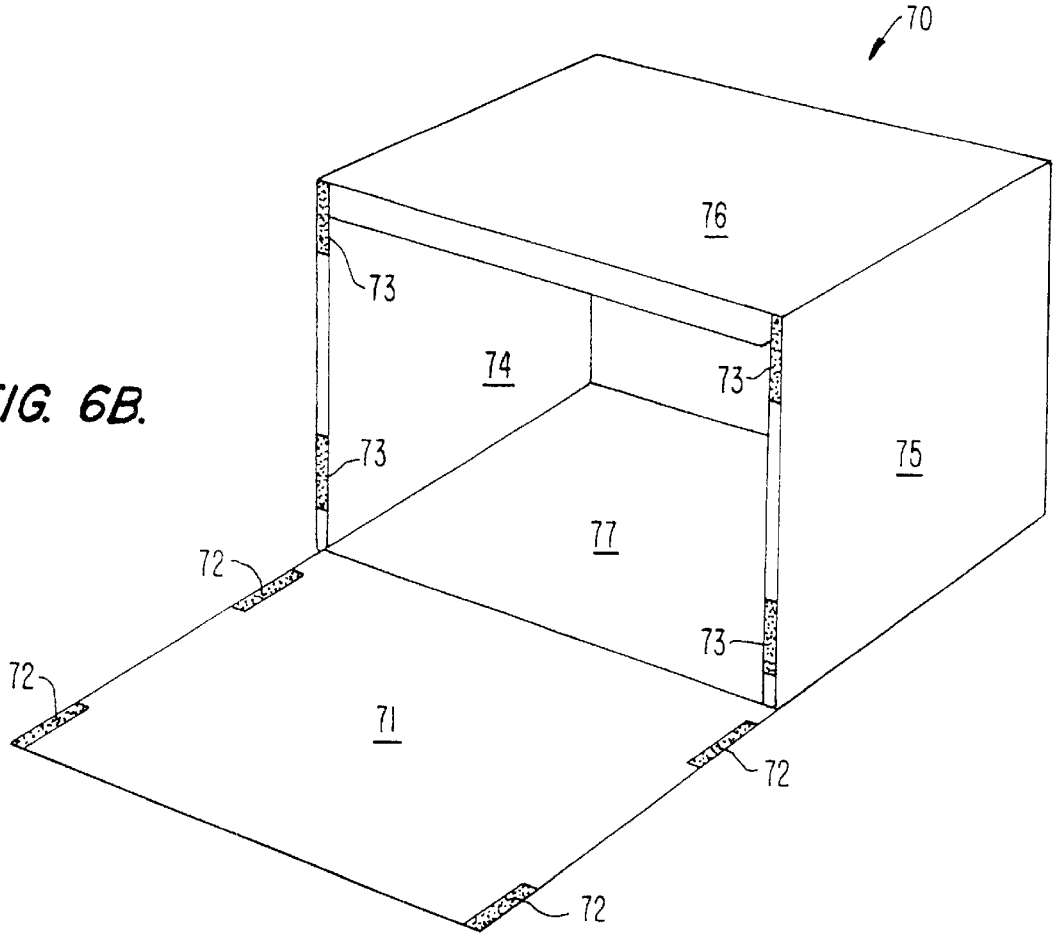

FIGS. 6(*a*) and 6(*b*) show another releasable fastening mechanism in a box 60 for releasably fastening a side-opening front panel 61 to the remainder of the box. As shown in the embodiment of FIG. 6(*a*), the front panel 61 has one or more coupling members 62 along an upper edge. One or more complementary coupling members 63 are provided on the lid flap 64 of the top 65. The complementary coupling members 63 are coupled to the coupling members 62 in the closed position to secure the front panel 61 to the lid flap 64. In this embodiment, the front panel 61 has a latching tab 66 and handle 67, and the lid flap 64 has a slot 68 for receiving the latching tab 66. The remaining components of the box 60 are similar to those shown in FIGS. 1(*a*)–2(*f*).

Figure 7:
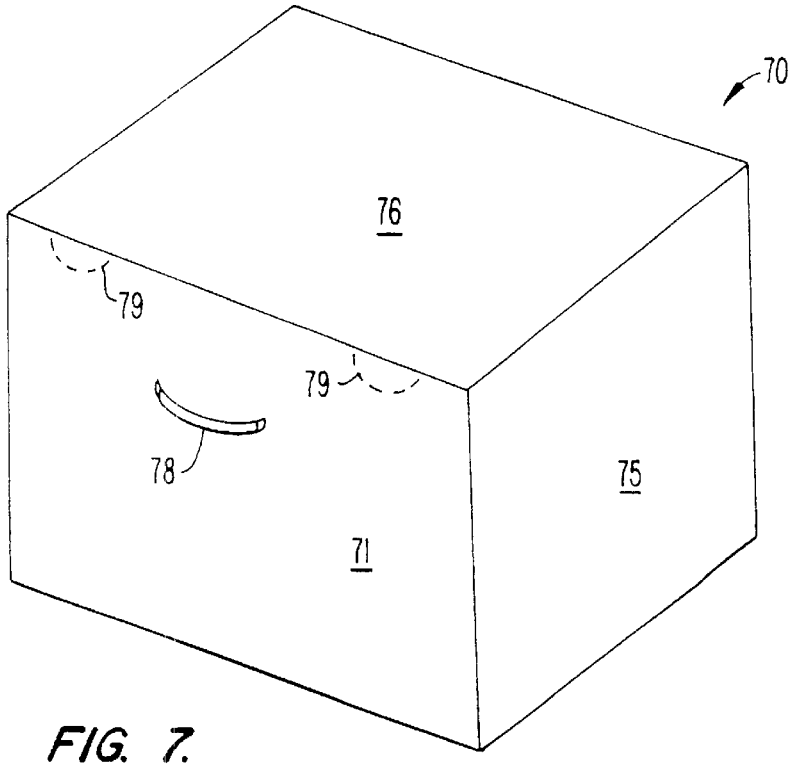
FIG. 7 is a perspective view of the box in FIG. 6(*b*) with the side-opening panel in the closed position.

In FIG. 6(*b*), the box 70 includes a front panel 71 having one or more coupling members 72 along each side edge. One or more complementary coupling members 73 are provided on the edges of the side walls 74, 75 which are connected between the top 76 and bottom 77. The complementary coupling members 73 are coupled to the coupling members 72 in the closed position to secure the front panel 71 to the side walls 74, 75. In this embodiment, the front panel 71 has no latching tab since the coupling members 72, 73 serve as releasable fasteners for the front panel 71. As shown in FIG. 7, the front panel 71 includes a handle 78 for the user to open and close the front panel 71. Instead of the handle 78, cutouts 79 may be used.

The coupling members and complementary coupling members may include, for example, magnetic strips, Velcro strips, mechanical couplers such as hooks, or the like.

Figure 8:
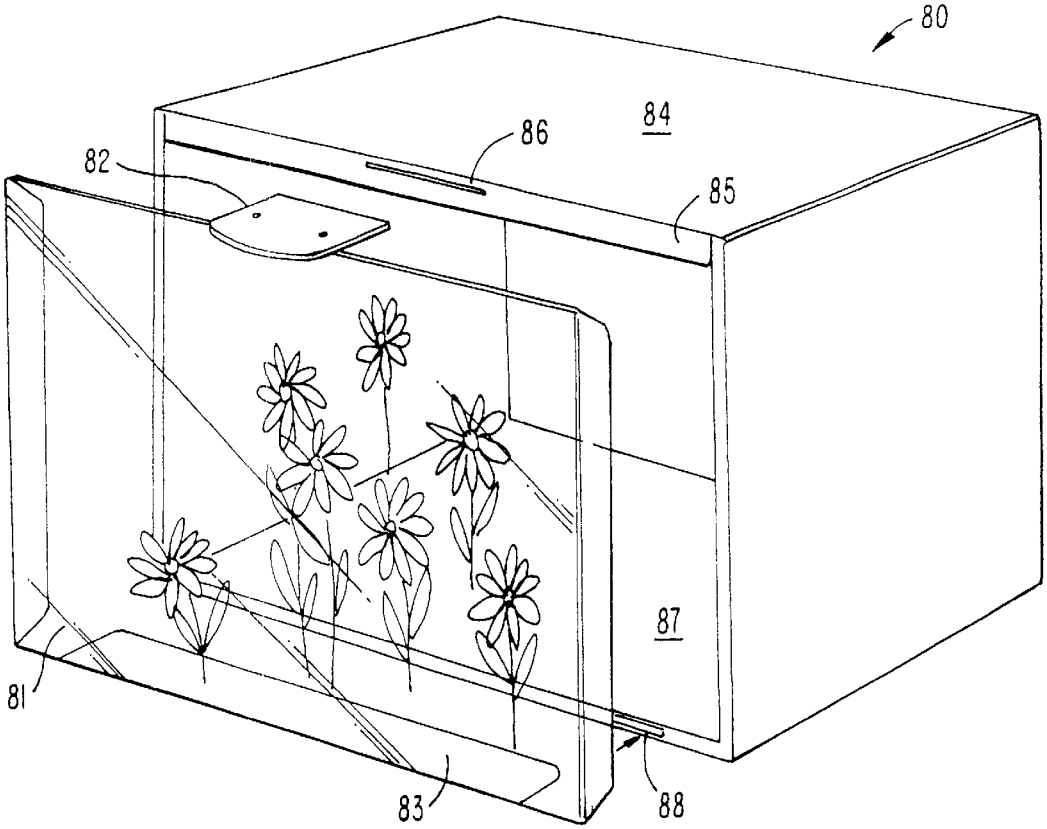
FIG. 8 is a perspective view of a box illustrating a side-opening panel having a transparent portion.
Figure 8A:
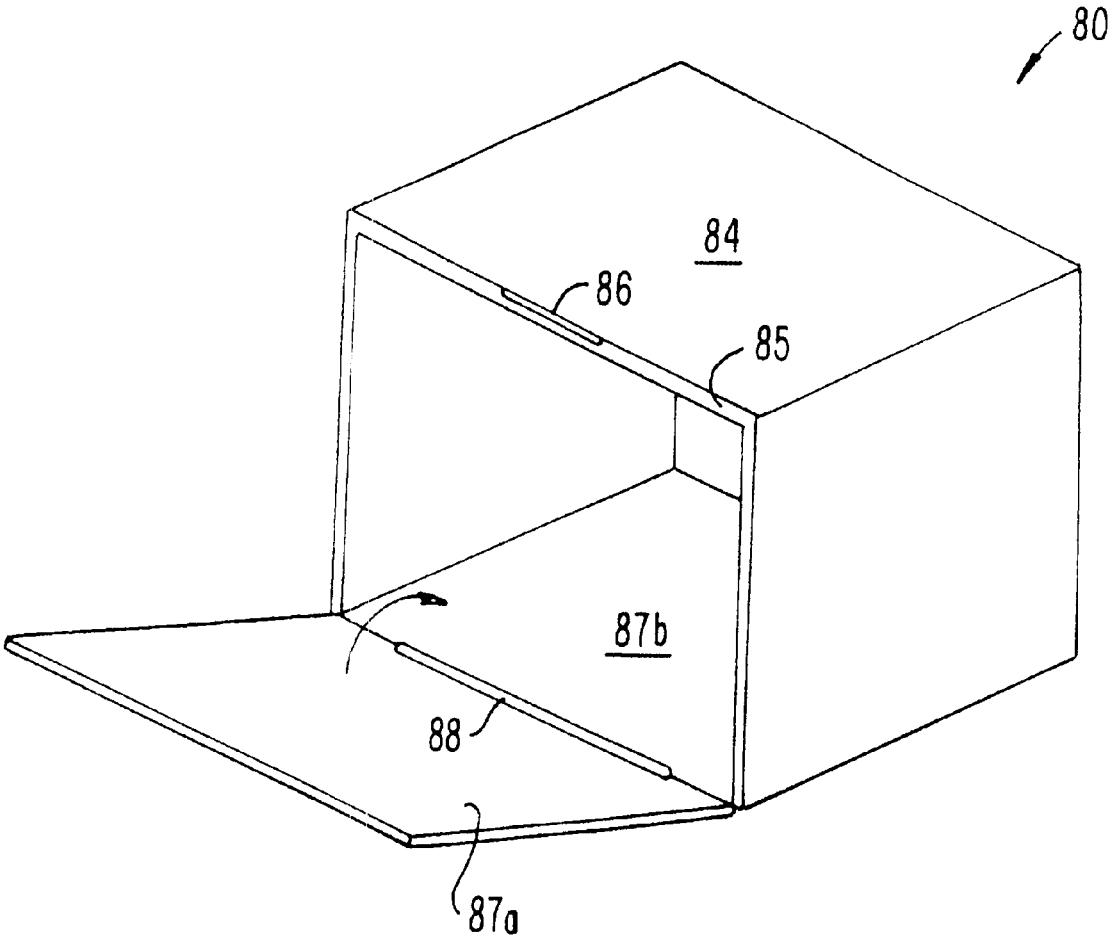
FIG. 8*a* is a perspective view of the box of FIG. 8 illustrating an alternative embodiment.

FIG. 8 shows a box 80 having a transparent front panel 81 which may include a decorative pattern such as that shown. The front panel 81 is made of a transparent material which, as used herein, includes materials that are transparent or substantially or partially transparent. Examples of suitable materials include polypropylene, PVC, other clear plastics, and the like. The pattern can be formed by silk-screening or the like. The front panel 81 may be taped, glued, or otherwise attached at the bottom to the box 80. In the embodiment shown in FIG. 8, the front panel 81 has a latching tab and handle 82 at the top and a latching flap 83 at the bottom. The top 84 includes a lid flap 85 having a slot 86 for receiving the latching tab 82. The bottom 87 includes a slot 88 for receiving the latching flap 83. The front panel 81 in this embodiment is detachable from the rest of the box 80. In one preferred embodiment, the bottom 87 includes an upper bottom panel 87*a* which folds into the box 80 over a lower bottom panel 87*b*, as seen in FIG. 8*a*. The slot 88 is formed between the two bottom panels 87*a*, 87*b*. The double-panel bottom 87 provides a strong and sturdy construction while conveniently providing the slot 88 between the overlapping panels 87*a*, 87*b* for receiving the latching flap 83.

Figure 9:
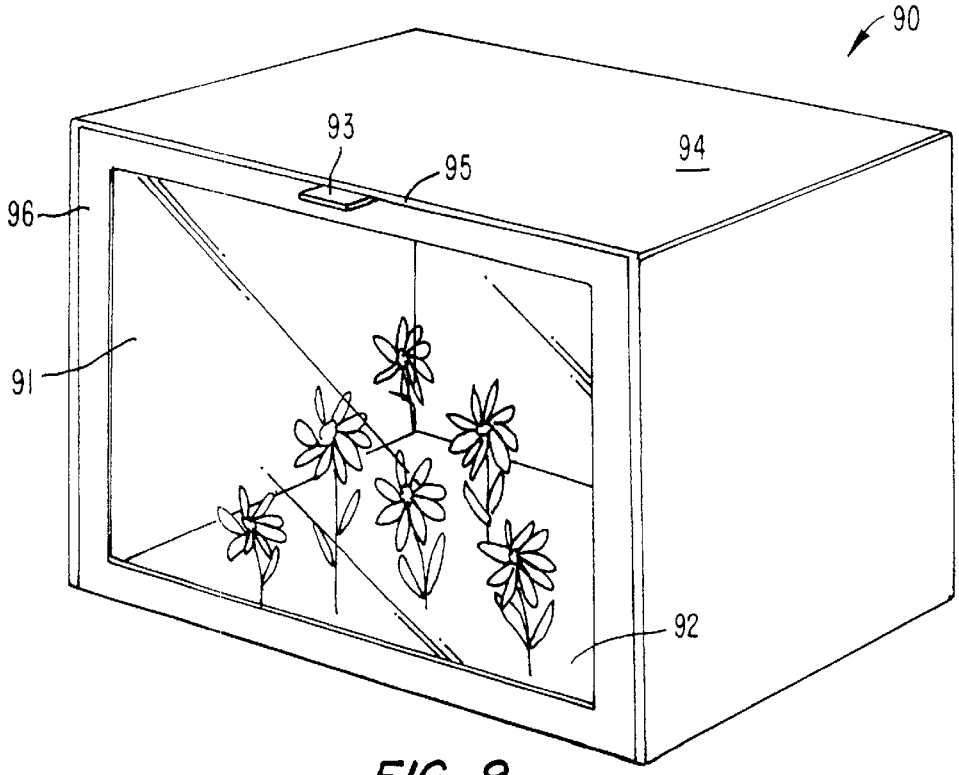
FIG. 9 is a perspective view of a box illustrating a transparent side-opening panel.

The box 90 in FIG. 9 includes a transparent front panel 91 that is attached to and foldable relative to the bottom 92 along the lower edge. The front panel 91 includes a latching tab and handle 93 at the top, and the top 94 has a slot 95 for receiving the latching tab 93. The transparent front panel 91 is surrounded by an opaque border or frame 96. The transparent portion 91 may be attached to the frame 96 using glue or other adhesives or by other suitable methods.

The above-described arrangements of apparatus and methods are merely illustrative of applications of the principles of this invention and many other embodiments and modifications may be made without departing from the spirit and scope of the invention as defined in the claims. For instance, the multi-panel walls may include fewer or more layers. The various fastening and attachment mechanisms in the box may vary. Different materials may be used for the box components. The scope of the invention should, therefore, be determined not with reference to the above description, but instead should be determined with reference to the appended claims along with their full scope of equivalents.

What is claimed is:

1. A single-piece side-loading box, comprising:

a bottom;

a plurality of wall panels;

atop;and a side-opening panel;

wherein the bottom, wall panels, top, and side-opening panel are fabricated in a unitary piece which is foldable from an unformed configuration to a box configuration with the side-opening panel openable in the box configuration to permit access to an interior of the box, the plurality of wall panels being connected between the top and the bottom in the box configuration, at least some of the wall panels in the box configuration overlapping to form one or more multi-panel walls;

wherein the plurality of wall panels form a back wall and two side walls which are each connected between the top and the bottom in the box configuration, wherein the unitary piece includes the top attached to and foldable relative to a back wall panel, wherein the back wall panel is attached to and foldable relative to the bottom, wherein the bottom is attached to and foldable relative to a pair of side wall panels disposed on opposite sides of the bottom, wherein the top is attached to and foldable relative to a pair of depending side reinforcement panels disposed on opposite sides of the top, the pair of depending side reinforcement panels overlapping with the pair of side wall panels, respectively, to form the pair of multi-panel side walls, wherein the pair of side wall panels are each connected to and foldable relative to a reinforcing side-wing panel, the reinforcing side-wing panels overlapping with the pair of side wall panels and the pair of depending side reinforcement panels, respectively, to form the pair of multi-panel side walls.

2. The side-loading box of claim 1 wherein the side wall panel, reinforcing side-wing panel, and depending side reinforcement panel on each side which overlap with each other include cut-outs which are aligned with each other in the box configuration.

3. The side-loading box of claim 1 herein the multi-panel wall includes a triple panel wall having three overlapping wall panels.

4. A single-piece side-loading box, comprising:

a bottom;

a plurality of wall panels;

a top; and a side-opening panel;

wherein the bottom, wall panels, top, and side-opening panel are fabricated in a unitary piece which is foldable from an unformed configuration to a box configuration with the side-opening panel openable in the box configuration to permit access to an interior of the box, the plurality of wall panels being connected between the top and the bottom in the box configuration, at least some of the wall panels in the box configuration overlapping to form one or more multi-panel walls;

wherein the plurality of wall panels form a back wall and two side walls which are each connected between the top and the bottom in the box configuration, wherein the unitary piece includes the top attached to and foldable relative to a back wall panel, wherein the back wall panel is attached to and foldable relative to the bottom, wherein the bottom is attached to and foldable relative to a pair of side wall panels disposed on opposite sides of the bottom, wherein the pair of side wall panels are each connected to and foldable relative to a back reinforcement panel, the back reinforcement panels overlapping with the back wall panel to form a multi-panel back wall.

5. The side-loading box of claim 4 wherein the back reinforcement panels include slots for interlocking the back reinforcement panels together.

6. The side-loading box of claim 4 wherein the bottom includes one or more tabs configured to protrude from the floor, and wherein the top includes one or more slots, the slots configured to receive the tabs protruding from the bottom of another box.

7. The side-loading box of claim 4 wherein at least a portion of the box is coated with a coating or lamination.

8. A single-piece side-loading box, comprising:

a bottom;

a plurality of wall panels;

a top; and a side-opening panel;

wherein the bottom, wall panels, top, and side-opening panel are fabricated in a unitary piece which is foldable from an unformed configuration to a box configuration with the side-opening panel openable in the box configuration to permit access to an interior of the box, the plurality of wall panels being connected between the top and the bottom in the box configuration, at least some of the wall panels in the box configuration overlapping to form one or more multi-panel walls;

wherein the plurality of wall panels form a back wall and two side walls which are each connected between the top and the bottom in the box configuration, wherein the unitary piece includes the top attached to and foldable relative to a back wall panel, wherein the back wall panel is attached to and foldable relative to the bottom, wherein the bottom is attached to and foldable relative to a pair of side wall panels disposed on opposite sides of the bottom, wherein the bottom is attached to and foldable relative to the side-opening panel.

9. A single-piece side-loading box, comprising:

a bottom;

a plurality of wall panels;

a top;

a side-opening panel, wherein the bottom, wall panels, top, and side-opening panel are fabricated in a unitary piece which is foldable from an unformed configuration to a box configuration with the side-opening panel movable between a closed position and an open position in the box configuration to permit access to an interior of the box, the plurality of wall panels being connected between the top and the bottom in the box configuration; and a releasable fastening and handle mechanism coupled to the side-opening panel for releasably fastening the side-opening panel in the closed position, wherein the releasable fastening and handle mechanism comprises a latching tab with a handle attached to and being integrally formed with the side-opening panel, and wherein one of the top, bottom, and wall panels includes a flap with a slot for receiving the latching tab.

10. A single-piece side-loading box, comprising:

a bottom;

a plurality of wall panels;

a top;

a side-opening panel, wherein the bottom, wall panels, top, and side-opening panel are fabricated in a unitary piece which is foldable from an unformed configuration to a box configuration with the side-opening panel movable between a closed position and an open position in the box configuration to permit access to an interior of the box, the plurality of wall panels being connected between the top and the bottom in the box configuration; and a releasable fastening and handle mechanism coupled to the side-opening panel for releasably fastening the side-opening panel in the closed position, wherein the releasable fastening and handle mechanism comprises at least one coupling member on the side-opening panel for coupling with at least one complementary coupling member on at least one of the top, bottom, and wall panels, wherein the coupling member and complementary coupling member are each selected from the group consisting of a magnetic member, a Velcro strip, a mechanical coupler, and a latching tab.

11. The side-loading box of claim 10 wherein the complementary coupling member is on a flap extending from at least one of the top, bottom, and wall panels.

12. The side-loading box of claim 10 wherein the side-opening panel is attached to and foldable relative to the bottom.

13. A side-loading box, comprising:

a bottom including a plurality of bottom panels overlapping to form a multipanel bottom and including a slot formed between two of the overlapping bottom panels;

a plurality of wall panels;

a top, wherein the top, bottom, and wall panels are fabricated in a unitary piece which is foldable from an unformed configuration to a box configuration, the plurality of wall panels being connected between the top and the bottom in the box configuration; and a side-opening panel movable between a closed position and an open position in the box configuration to permit access to an interior of the box, the side-opening panel including a latching flap insertable into the slot of the multi-panel bottom.

14. The side-loading box of claim 13 wherein the side-opening panel is a separate panel detachably connected to the unitary piece in the box configuration.

15. The side-loading box of claim 13 wherein the entire side loading panel is transparent.

16. The side-loading box of claim 13 wherein the side-opening panel comprises a transparent portion mounted on an opaque portion.

17. The side-loading box of claim 16 wherein the side-opening panel includes an opaque border surrounding the transparent portion.

18. The side-loading box of claim 16 wherein the unitary piece includes the side-opening panel.

19. The side-loading box of claim 13 further comprising one or more inserts for organizing articles stored within the box.

* * * * *